US008009806B2

(12) United States Patent
Legall

(10) Patent No.: US 8,009,806 B2
(45) Date of Patent: Aug. 30, 2011

(54) APPARATUS AND METHOD OF COOLING A LIQUID METAL BEARING IN AN X-RAY TUBE

(75) Inventor: Edwin L. Legall, Menomenee Falls, WI (US)

(73) Assignee: General Electric Company, Schenectady, NY (US)

( * ) Notice: Subject to any disclaimer, the term of this patent is extended or adjusted under 35 U.S.C. 154(b) by 158 days.

(21) Appl. No.: 12/501,581

(22) Filed: Jul. 13, 2009

(65) Prior Publication Data

US 2011/0007877 A1 Jan. 13, 2011

(51) Int. Cl.
*H01J 35/10* (2006.01)

(52) U.S. Cl. ..... 378/132; 378/121; 378/127; 378/130; 378/133; 378/141

(58) Field of Classification Search ..... 378/121, 378/125, 127, 130, 131, 132, 133, 141, 199, 378/200
See application file for complete search history.

(56) References Cited

U.S. PATENT DOCUMENTS

| | | | | |
|---|---|---|---|---|
| 4,405,876 | A | 9/1983 | Iversen | |
| 4,455,504 | A | 6/1984 | Iversen | |
| 4,501,566 | A | 2/1985 | Carlson et al. | |
| 4,577,340 | A | 3/1986 | Carlson et al. | |
| 4,584,699 | A | 4/1986 | LaFiandra et al. | |
| 4,622,687 | A | 11/1986 | Whitaker et al. | |
| 4,625,324 | A | 11/1986 | Blaskis et al. | |
| 5,077,781 | A | 12/1991 | Iversen | |
| 5,204,890 | A * | 4/1993 | Anno et al. | 378/133 |
| 5,298,293 | A * | 3/1994 | Ono et al. | 427/560 |
| 5,340,122 | A | 8/1994 | Toboni et al. | |
| 5,416,820 | A * | 5/1995 | Weil et al. | 378/130 |
| 5,583,906 | A * | 12/1996 | Sugiura et al. | 378/132 |
| 5,668,849 | A * | 9/1997 | Sugiura et al. | 378/133 |
| 6,477,236 | B1 * | 11/2002 | Anno et al. | 378/144 |
| 6,594,340 | B2 * | 7/2003 | Saito | 378/130 |
| 7,050,541 | B2 * | 5/2006 | Bittl | 378/132 |
| 7,127,035 | B2 * | 10/2006 | Anno et al. | 378/133 |
| 7,197,115 | B2 | 3/2007 | Unger et al. | |
| 7,197,118 | B2 * | 3/2007 | Anno et al. | 378/130 |
| 7,248,673 | B2 | 7/2007 | Miller | |
| 7,327,828 | B1 | 2/2008 | Frontera et al. | |
| 7,508,916 | B2 | 3/2009 | Frontera et al. | |
| 7,519,158 | B2 | 4/2009 | Gadre et al. | |
| 7,697,665 | B2 * | 4/2010 | Yonezawa et al. | 378/130 |
| 7,746,982 | B2 * | 6/2010 | Yoshii et al. | 378/133 |
| 7,801,278 | B2 * | 9/2010 | Ito et al. | 378/133 |
| 2008/0107236 | A1 | 5/2008 | Gadre et al. | |
| 2008/0260105 | A1 | 10/2008 | Schaefer et al. | |

* cited by examiner

*Primary Examiner* — Allen C. Ho
(74) *Attorney, Agent, or Firm* — Ziolkowski Patent Solutions Group, SC

(57) ABSTRACT

An x-ray tube includes a center shaft having an inner surface and an outer surface, the inner surface forming a portion of a cavity therein, a mount having an inner surface, the mount having an x-ray target attached thereto, and a liquid metal positioned between the outer surface of the center shaft and the inner surface of the mount. The x-ray tube further includes a flow diverter positioned in the cavity, the flow diverter having a wall with an inner surface, and a plurality of jets passing through the wall, wherein the plurality of jets are configured such that when a fluid is flowed into the flow diverter and passes along its inner surface, a portion of the fluid passes through the plurality of jets and is directed toward the inner surface of the center shaft.

23 Claims, 4 Drawing Sheets

APPARATUS AND METHOD OF COOLING A LIQUID METAL BEARING IN AN X-RAY TUBE

BACKGROUND OF THE INVENTION

The invention relates generally to x-ray tubes and, more particularly, to a liquid metal bearing in an x-ray tube and a method of assembling same.

X-ray systems typically include an x-ray tube, a detector, and a bearing assembly to support the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector then emits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in a computed tomography (CT) package scanner.

X-ray tubes include a rotating anode structure for distributing the heat generated at a focal spot. The anode is typically rotated by an induction motor having a cylindrical rotor built into a cantilevered axle that supports a disc-shaped anode target and an iron stator structure with copper windings that surrounds an elongated neck of the x-ray tube. The rotor of the rotating anode assembly is driven by the stator. An x-ray tube cathode provides a focused electron beam that is accelerated across a cathode-to-anode vacuum gap and produces x-rays upon impact with the anode. Because of the high temperatures generated when the electron beam strikes the target, it is typically necessary to rotate the anode assembly at high rotational speed. This places stringent demands on the bearing assembly, which typically includes tool steel ball bearings and tool steel raceways positioned within the vacuum region, thereby requiring lubrication by a solid lubricant such as silver. Wear of the silver and loss thereof from the bearing contact region increases acoustic noise and slows the rotor during operation.

In addition, the operating conditions of newer generation x-ray tubes have become increasingly aggressive in terms of stresses because of G forces imposed by higher gantry speeds and higher anode run speeds. As a result, there is greater emphasis in finding bearing solutions for improved performance under the more stringent operating conditions.

A liquid metal bearing (i.e. a spiral groove bearing, or SGB) may be employed in lieu of ball bearings. Advantages of liquid metal bearings include a high load capability and a high heat transfer capability due to an increased amount of contact area as compared to a ball bearing. Advantages also include low acoustic noise operation. Gallium, indium, or tin alloys are typically used as the liquid metal, as they tend to be liquid at room temperature and have adequately low vapor pressure, at operating temperatures, to meet the rigorous high vacuum requirements of an x-ray tube.

However, liquid metals typically used in an SGB tend to be highly reactive and corrosive. The liquid metal of an SGB may react with a base metal that it contacts, thus consuming the liquid metal and shortening the life of the SGB. The rate of reaction is a function of temperature, and the temperature of an SGB tends to increase during operation—both because of high temperatures that occur during x-ray generation within the anode, and because of self-heating of the liquid metal. As such, the elevated operating temperature of the liquid metal may increase a loss rate of the liquid metal, leading to early life failure of the x-ray tube.

Therefore, it would be desirable to design an x-ray tube with an SGB having a reduced operating temperature therein.

BRIEF DESCRIPTION OF THE INVENTION

The invention provides an apparatus for improving an x-ray tube with a SGB bearing, that overcomes the aforementioned drawbacks.

According to one aspect of the invention, an x-ray tube includes a center shaft having an inner surface and an outer surface, the inner surface forming a portion of a cavity therein, a mount having an inner surface, the mount having an x-ray target attached thereto, and a liquid metal positioned between the outer surface of the center shaft and the inner surface of the mount. The x-ray tube further includes a flow diverter positioned in the cavity, the flow diverter having a wall with an inner surface, and a plurality of jets passing through the wall, wherein the plurality of jets are configured such that when a fluid is flowed into the flow diverter and passes along its inner surface, a portion of the fluid passes through the plurality of jets and is directed toward the inner surface of the center shaft.

In accordance with another aspect of the invention, a method of assembling an x-ray tube includes providing a center mount structure having an inner surface and an outer surface, forming a passageway in the center mount structure, the passageway configured to pass a coolant therein, providing a rotatable mount structure having an inner surface, and attaching a target to the rotatable mount structure. The method further includes applying a liquid metal to one of the outer surface of the center mount structure and the inner surface of the rotatable mount structure, coupling the rotatable mount structure to the center mount structure such that the liquid metal is positioned between the outer surface of the center mount structure and the inner surface of the rotatable mount structure, and coupling a porous material to the inner surface of the center mount structure.

Yet another aspect of the invention includes a spiral groove bearing (SGB) that includes a column having an outer diameter and an inner diameter, the inner diameter partially enclosing a hollow, a mount having a flange thereon, the mount having an inner diameter that is larger than the outer diameter of the column, wherein the flange is configured to attach an x-ray target thereto, and a liquid metal positioned between the outer diameter of the column and the inner diameter of the mount. The SGB also includes a porous-meshed heat transfer-enhancement media coupled to the inner diameter of the column.

Various other features and advantages of the invention will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION

Figure 1:
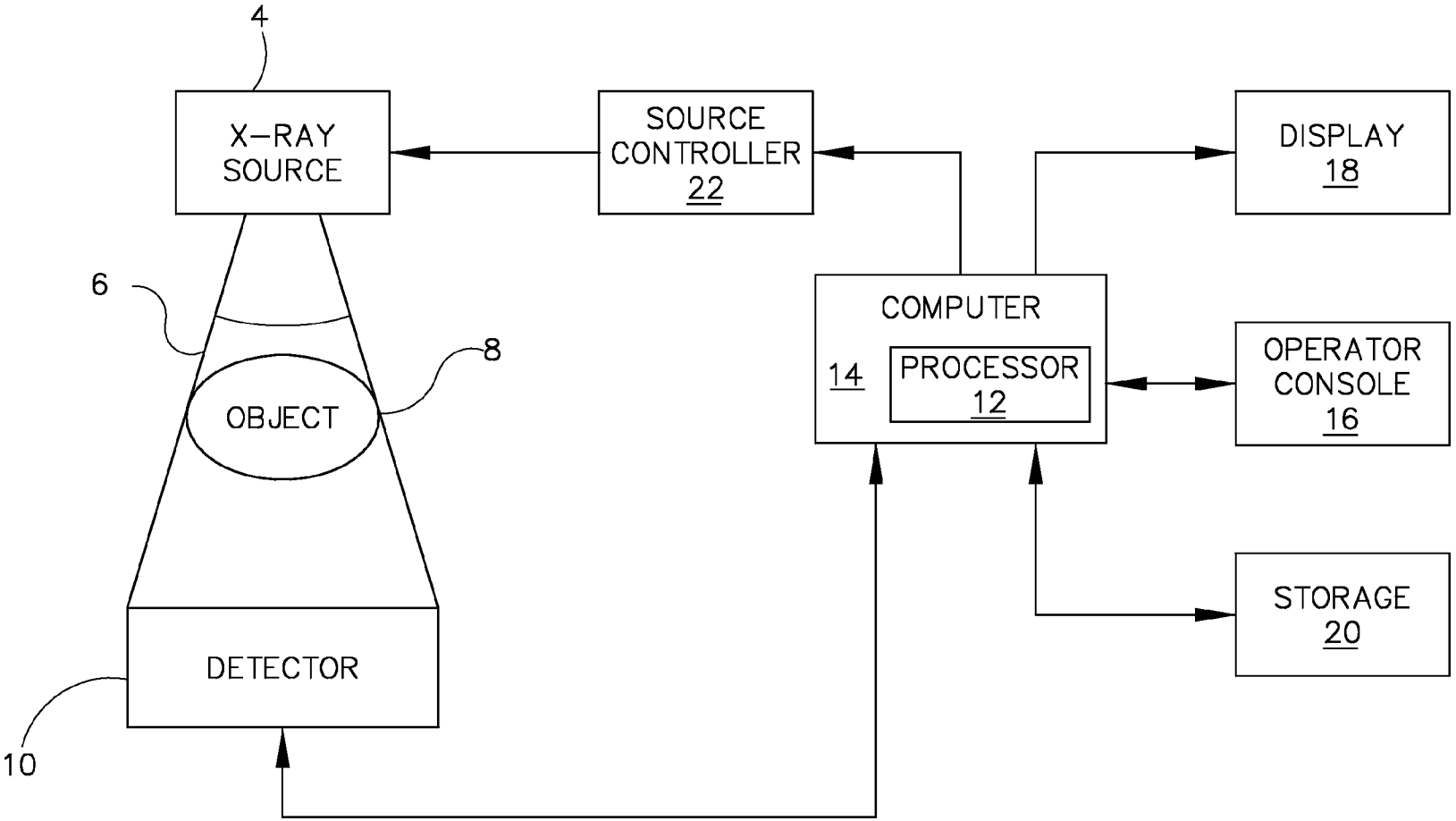
FIG. 1 is a block diagram of an imaging system that can benefit from incorporation of an embodiment of the invention.

FIG. 1 is a block diagram of an embodiment of an x-ray imaging system 2 designed both to acquire original image data and to process the image data for display and/or analysis in accordance with the invention. It will be appreciated by those skilled in the art that the invention is applicable to numerous medical imaging systems implementing an x-ray tube, such as x-ray or mammography systems. Other imaging systems such as computed tomography (CT) systems and digital radiography (RAD) systems, which acquire image three dimensional data for a volume, also benefit from the invention. The following discussion of imaging system 2 is merely an example of one such implementation and is not intended to be limiting in terms of modality.

As shown in FIG. 1, imaging system 2 includes an x-ray tube or source 4 configured to project a beam of x-rays 6 through an object 8. Object 8 may include a human subject, pieces of baggage, or other objects desired to be scanned. X-ray source 4 may be a conventional x-ray tube producing x-rays having a spectrum of energies that range, typically, from 30 keV to 200 keV. The x-rays 6 pass through object 8 and, after being attenuated by the object, impinge upon a detector 10. Each detector in detector 10 produces an analog electrical signal that represents the intensity of an impinging x-ray beam, and hence the attenuated beam, as it passes through the object 8. In one embodiment, detector 10 is a scintillation based detector, however, it is also envisioned that direct-conversion type detectors (e.g., CZT detectors, etc.) may also be implemented.

A processor 12 receives the signals from the detector 10 and generates an image corresponding to the object 8 being scanned. A computer 14 communicates with processor 12 to enable an operator, using operator console 16, to control the scanning parameters and to view the generated image. That is, operator console 16 includes some form of operator interface, such as a keyboard, mouse, voice activated controller, or any other suitable input apparatus that allows an operator to control the imaging system 2 and view the reconstructed image or other data from computer 14 on a display unit 18. Additionally, operator console 16 allows an operator to store the generated image in a storage device 20 which may include hard drives, flash memory, compact discs, etc. The operator may also use operator console 16 to provide commands and instructions to computer 14 for controlling a source controller 22 that provides power and timing signals to x-ray source 4.

Figure 2:
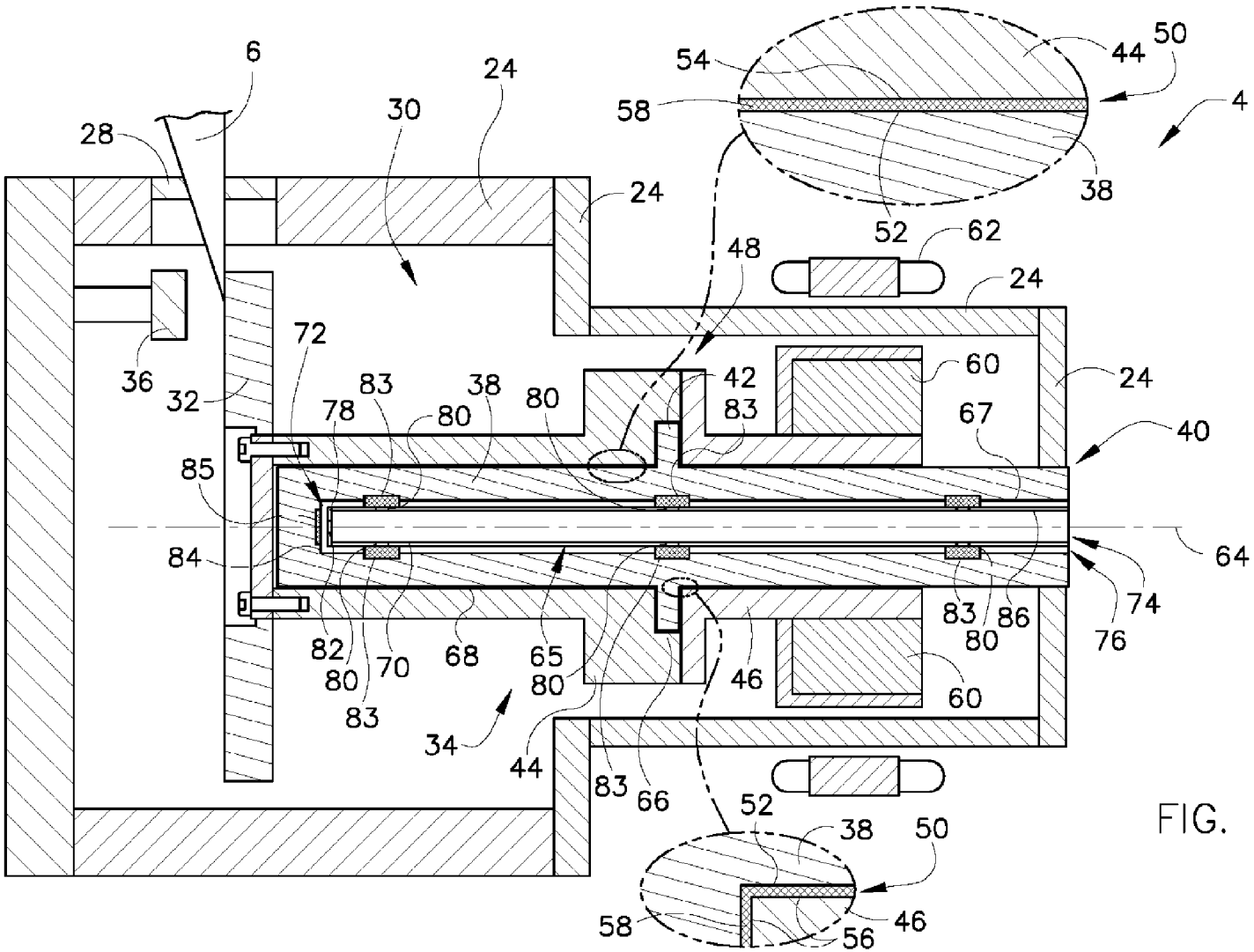
FIG. 2 illustrates a cross-sectional view of an x-ray tube according to an embodiment of the invention.

FIG. 2 illustrates a cross-sectional view of x-ray tube or source 4 incorporating embodiments of the invention. The x-ray source 4 includes a frame 24 having a radiation emission passage 28 therein that allows x-rays 6 to pass therethrough. Frame 24 encloses an x-ray tube volume 30, which houses a target or anode 32, a spiral groove bearing (SGB) assembly 34, and a cathode 36. The SGB 34 includes a center shaft, column, or center mount structure 38 that is configured to be attached to frame 24 at attachment point 40. In one embodiment, center shaft 38 includes a radial projection 42 that is configured to axially limit the motion or translation of first and second sleeves 44, 46. The SGB 34 includes a rotatable mount structure that includes first sleeve 44 and second sleeve 46 that are separable at separation location 48 to facilitate assembly and disassembly of SGB 34. SGB 34 includes a gap 50 formed between an outer surface 52 of center shaft 38 and an inner surface 54 of first sleeve 44. Similarly, gap 50 is formed between outer surface 52 of center shaft 38 and inner surfaces 56 of second sleeve 46. A liquid metal 58 is positioned within gap 50, and in embodiments of the invention, liquid metal 58 comprises gallium, tin, indium, and alloys thereof, as examples. SGB 34 includes a rotor 60 attached to second sleeve 46. A stator 62 is attached (attachment not shown) to frame 24 of x-ray tube 4.

Liquid metal 58 serves to support first sleeve 44, second sleeve 46, and target 32. Liquid metal 58 thereby functions as a lubricant between rotating and stationary components. In the embodiment illustrated, center shaft 38 is caused to be stationary with respect to frame 24, and target 32, first sleeve 44, and second sleeve 46 are caused to rotate about an axis of rotation 64 of x-ray tube 4. Thus, x-rays 6 are produced when high-speed electrons are suddenly decelerated when directed from the cathode 36 to the anode 32 via a potential difference therebetween of, for example, 60 thousand volts or more in the case of CT applications. The x-rays 6 are emitted through radiation emission passage 28 toward a detector array, such as detector 10 of FIG. 1. To avoid overheating the anode 32 from the electrons, rotor 60 and stator 62 rotate the anode 32 at a high rate of speed about centerline 64 at, for example, 90-250 Hz. However, because of the heating from x-ray generation in the anode 32, and because of self-heating of the liquid metal 58 in gap 50, the life of SGB 34 and therefore x-ray tube 4 in general may be limited because of the accelerating affects of high temperature of the reactive liquid metal. As such, SGB 34 includes a hollow or cavity 65 formed in part by an inner surface 67 for passage of liquid coolant therein.

Heating within liquid metal 58 may be non-uniform because of various features of SGB 34. For instance, some locations or surfaces within SGB 34 may have a higher relative motion than other surfaces. As an example, radial projection 42 has a radial diameter 66 that is greater than at other surfaces within SGB 34, such as at diameter 68. Thus, because of the increased radial diameter of radial projection 42, a higher relative surface velocity occurs at diameter 66 than at diameter 68. As such, radial projection 42 may cause localized heating within SGB 34 and may cause liquid metal 58 at diameter 66 to have an increased temperature above liquid metal 58 at other locations, such as at diameter 68.

SGBs typically include angled grooves for containing liquid metal therein and preventing loss of liquid metal from gaps such as gap 50 of SGB 34, as is commonly understood in the art. For instance, grooves may be positioned on outer surface 52 of center shaft 38, on inner surface 54 of first sleeve 44, on inner surfaces 56 of second sleeve 46, and on combinations thereof. Thus, though the grooves function to contain liquid metal 58 within gap 50, they do so at the expense of increased frictional heating within SGB 34 of liquid metal 58. As such, locations that include grooves may experience an increased temperature relative to locations within gap 50 that do not include angled grooves.

Thus, localized heating may occur within SGB 34 for at least the two reasons outlined above. As such, because a rate of corrosion or reaction is typically temperature dependent and increases with increasing temperature, hot spots may form within SGB 34 that may precipitate early life failure of x-ray tube 4. Accordingly, cavity 65 of SGB 34 includes a flow diverter or flow separator 70 according to embodiments of the invention. Flow separator 70 is positioned therein having a fluid inlet 74 and an annular fluid exit 76. Flow separator 70 includes an axial endcap 78 that prevents axial flow of fluid from passing unimpeded by end 72 of flow separator 70.

Flow separator 70 includes a plurality of nozzles, jets, or passageways 80 positioned therein, according to an embodiment of the invention. Jets 80 are configured to direct fluid toward inner surface 67 of cavity 65, and in embodiments of the invention, jets 80 are selectively positioned to direct fluid toward specific locations of inner surface 67 that otherwise would have increased temperatures for reasons as stated above. In embodiments of the invention, axial endcap may 78 include one or more nozzles 82 that pass fluid toward a surface 84 of cavity 65.

In another embodiment of the invention, SGB 34 includes one or more porous or heat transfer-enhancement media 83, 85 coupled to inner surfaces 67, 84, respectively, of cavity 65. According to embodiments, media 83, 85 include foam comprised of graphite, copper, aluminum, and the like that may be coupled to surfaces 67, 84 by an interference fit, by brazing, or other mechanical attachments. Thus, because of an increased surface area within media 83, 85 as compared to surfaces 67, 84, and because media 83, 85 tend to increase turbulence of fluid passing therethrough, heat transfer tends to be dramatically increased as compared to natural or forced convection occurring over a surface such as surfaces 67, 84. And, as illustrated, media 83, 85 may be embedded within surfaces 67, 84 and between surfaces 67, 84 and flow separator 70. In one embodiment media 83, 85 is not embedded within surfaces 67, 84. Further, although media 83, 85 are positioned intermittently along surfaces 67, 84, media 83 may extend over an entire axial length of surface 67, and media 85 may extend over an entire area of surface 84. Media 83, 85 may provide structural support for the flow separator 70.

Heat transfer may be further enhanced by combining nozzles and heat transfer media within SGB 34. Thus, although embodiments described above may include only nozzles 80, 82, it is to be understood that embodiments include both nozzles 80, 82 and media 83, 85 in a single embodiment. Further, in such an embodiment, nozzles 80, 82 and media 83, 85 may be selectively placed within SGB 34 at hot spots therein, or may include nozzles 80, 82 and media 83, 85 positioned therein along and throughout the entire surfaces 67, 84 of SGB 34.

Thus, in operation, target 32 is caused to rotate about axis of rotation 64 via rotor 60, which is mechanically coupled thereto via first and second sleeves 44, 46. Cooling fluid, which may include a liquid such as dielectric oil, ethylene glycol, propylene glycol, and the like, or which may include a gas such as air, nitrogen, argon, and the like, is pressurized and caused to flow into flow separator 70 at inlet 74. Fluid thus flows along an inner surface 86 of flow separator 70 and passes through jets 80, 82 and is caused to impinge upon surfaces 67, 84 of cavity 65. Accordingly, because fluid velocity is typically increased as it passes through jets 80, 82, heat transfer from surfaces 67, 84 is thereby enhanced because of an increased convection coefficient. Further, in an embodiment that includes heat transfer-enhancement media 83, 85, heat transfer is further enhanced as fluid passes through jets 80, 82 and impinges on media 83, 85. As such, such embodiments enhance heat transfer within SGB 34 and cause liquid metal 58 to decrease in temperature.

Further, because of the increased capability to transfer heat, such an embodiment may increase an amount of heat transferred from target 32 into SGB 34. And, although x-ray tube designs typically include materials having a high thermal resistance between the target and the shaft on which it is mounted in order to reduce heat transfer to the shaft, in the embodiments illustrated herein, such steps may be unnecessary. Thus, because of the enhancements to heat transfer within SGB 34 as disclosed herein, target 32 may operate at a cooler temperature than would otherwise be experienced without such enhancements.

Figure 3:
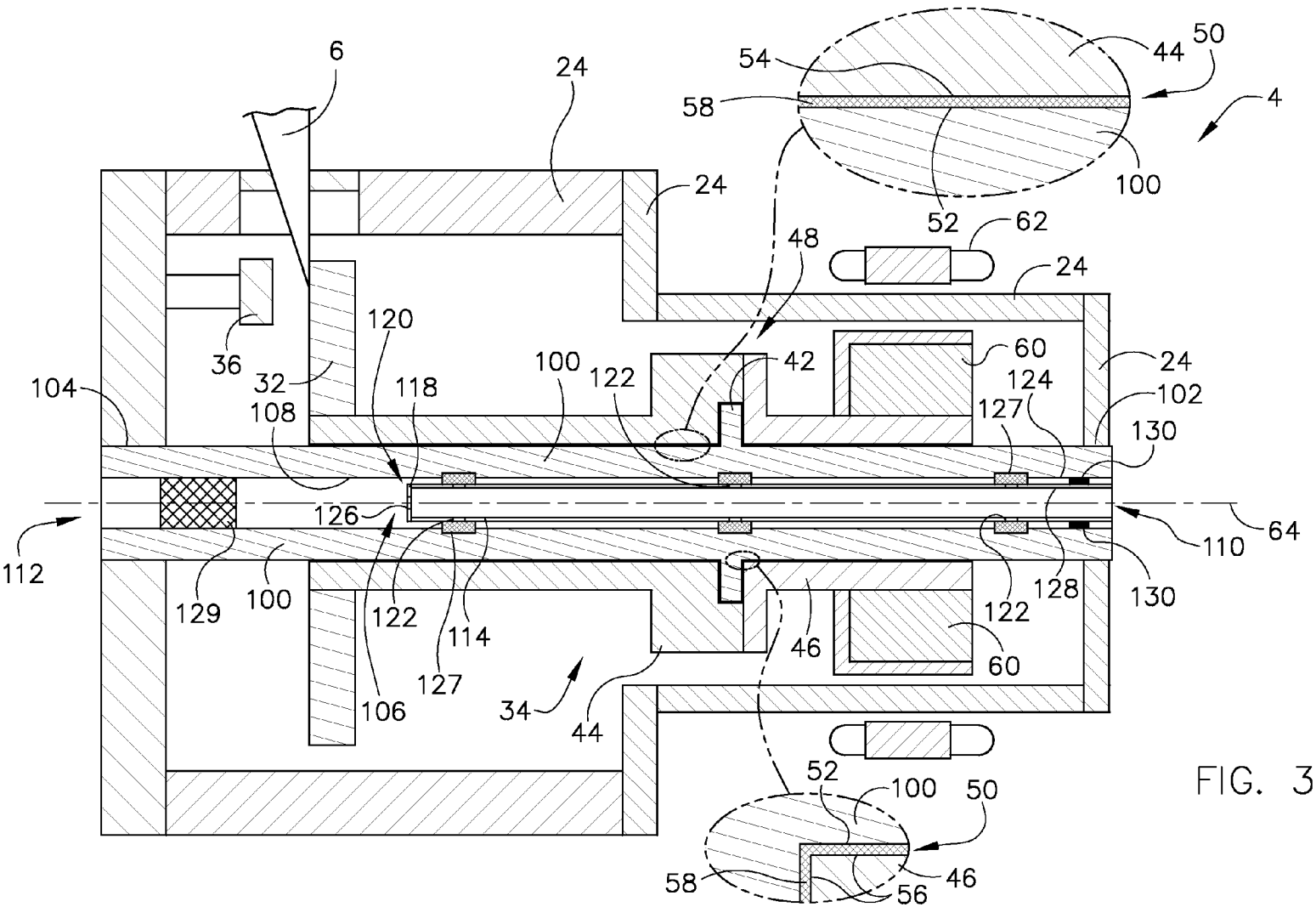
FIG. 3 illustrates a cross-sectional view of an x-ray tube according to another embodiment of the invention.

FIG. 3 illustrates a cross-sectional view of x-ray tube or source 4 according to another embodiment of the invention. According to this embodiment, x-ray tube 4 includes frame 24, rotor 60, and stator 62. X-ray tube 4 also includes target 32 and cathode 36 positioned to emit electrons toward target 32, to emit x-rays 6 therefrom. X-ray tube 4 includes SGB 34 coupled to rotor 60 and configured to support target 32. Thus, as with that illustrated in FIG. 2, x-ray tube 4 may be controlled to rotate target 32 from rotor 60 via stator 62. And, as with that illustrated in FIG. 2, SGB 34 includes first and second sleeves 44, 46 having separation location 48 to facilitate assembly and disassembly of SGB 34.

According to this embodiment, x-ray tube 4 includes a center shaft, column, or center mount structure 100 that is configured to be attached to frame 24 at attachment points 102, 104. SGB 34 includes gap 50 formed between outer surface 52 of center shaft 100 and inner surface 54 of first sleeve 44. Similarly, gap 50 is formed between outer surface 52 of center shaft 100 and inner surfaces 56 of second sleeve 46. Liquid metal 58 is positioned within gap 50, and in embodiments of the invention, liquid metal 58 comprises gallium, tin, indium, and alloys thereof, as examples.

Center shaft 100 includes a hollow or cavity 106 formed by an inner surface 108 of center shaft 100 for passage of liquid coolant therein, and center shaft 100 includes an inlet 110 and an outlet 112. Thus, fluid may be passed from inlet 110 to outlet 112 and as a consequence, heat energy may be drawn from SGB 34 during operation thereof. According to one embodiment, cavity 106 of SGB 34 includes a flow diverter or flow separator 114. This embodiment may include an annular obstruction 130 attached or coupled to flow separator 114 and positioned to prevent flow from passing from inlet 110 and then flowing back toward inlet 110 once it passes through passageways 122 positioned therein. Flow separator 114 includes an axial endcap 118 that prevents axial flow of fluid from passing unimpeded by end 120 of flow separator 114.

Passageways 122 may include a nozzles, jets, and the like that direct and accelerate fluid passing therethrough. Passageways 122 are configured to direct fluid toward surface 124 of cavity 106, and in embodiments of the invention, passageways 122 are selectively positioned to direct fluid toward specific locations of surface 124 that otherwise would have increased temperatures for reasons as stated above. In embodiments of the invention, axial endcap may 118 include one or more nozzles or passageways 126 that pass fluid therethrough, which may function to regulate passage of fluid therein. According to one embodiment, heat transfer-enhancement media 127 are included in SGB 34 and are positioned either on surface 124 of SGB 34, or embedded therein. Further, although illustrated as being intermittently positioned along surface 124, media 127 may be positioned along selective portions or an entire axial length of surface 124.

In one embodiment, a porous media 129 having an annular shape, or one or more disks of media positioned within cavity 106, may be attached to inner surface 108 of center shaft 100. Thus, in this embodiment, porous media 129 may further enhance heat transfer of fluid passing through flow diverter 114 and passing through passageways 122 before exiting cavity 106 at fluid exit 112. In yet another embodiment of the invention, no flow separator 114 is provided and in this embodiment porous media 129 may be positioned anywhere within cavity 106 at one or multiple locations, or along much or all of the length of cavity 106. This embodiment may or may not include porous media 129, depending on desired heat transfer characteristics within cavity 106. Thus, in this embodiment, fluid may pass from inlet 110, into cavity 106, and through porous media 129 before passing through fluid exit 112.

Thus, in operation, target 32 is caused to rotate about axis of rotation 64 via rotor 60, which is mechanically coupled thereto via first and second sleeves 44, 46. Cooling fluid, which may include a liquid such as dielectric oil, ethylene glycol, propylene glycol, and the like, or which may include a gas such as air, nitrogen, argon, and the like, is pressurized and caused to flow into flow separator 114 at fluid inlet 110. Fluid thus flows along an inner surface 128 of flow separator 114 and passes through jets 122 and passageways 126 and is caused to impinge upon surface 124 of cavity 106, or upon heat transfer-enhancement media 127. Accordingly, because fluid velocity is typically increased as it passes through jets 122, heat transfer from surface 124 is thereby enhanced because of an increased convection coefficient. Likewise, in alternate embodiments, a porous media 129 may be included and fluid passing therethrough may enhance convection therein. Such embodiments may be used alone and without a flow separator 114, or may be used in conjunction therewith, and in any and all combinations thereof to enhance convection within cavity 106.

Figure 4:
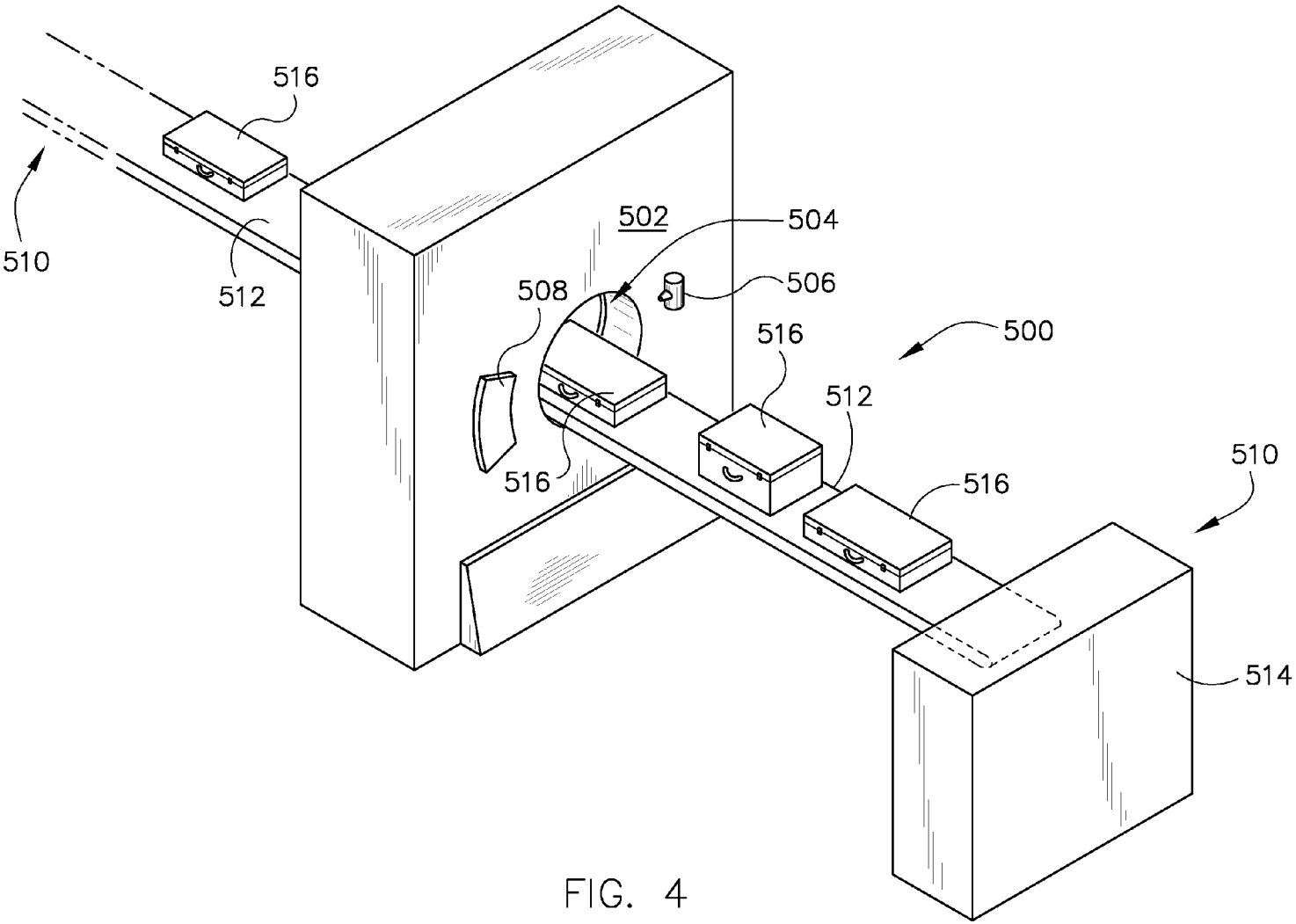
FIG. 4 is a pictorial view of an x-ray system for use with a non-invasive package inspection system incorporating embodiments of the invention.

FIG. 4 is a pictorial view of an x-ray system 500 for use with a non-invasive package inspection system. The x-ray system 500 includes a gantry 502 having an opening 504 therein through which packages or pieces of baggage may pass. The gantry 502 houses a high frequency electromagnetic energy source, such as an x-ray tube 506, and a detector assembly 508. A conveyor system 510 is also provided and includes a conveyor belt 512 supported by structure 514 to automatically and continuously pass packages or baggage pieces 516 through opening 504 to be scanned. Objects 516 are fed through opening 504 by conveyor belt 512, imaging data is then acquired, and the conveyor belt 512 removes the packages 516 from opening 504 in a controlled and continuous manner. As a result, postal inspectors, baggage handlers, and other security personnel may non-invasively inspect the contents of packages 516 for explosives, knives, guns, contraband, etc. One skilled in the art will recognize that gantry 502 may be stationary or rotatable. In the case of a rotatable gantry 502, system 500 may be configured to operate as a CT system for baggage scanning or other industrial or medical applications.

Therefore, according to one embodiment of the invention, an x-ray tube includes a center shaft having an inner surface and an outer surface, the inner surface forming a portion of a cavity therein, a mount having an inner surface, the mount having an x-ray target attached thereto, and a liquid metal positioned between the outer surface of the center shaft and the inner surface of the mount. The x-ray tube further includes a flow diverter positioned in the cavity, the flow diverter having a wall with an inner surface, and a plurality of jets passing through the wall, wherein the plurality of jets are configured such that when a fluid is flowed into the flow diverter and passes along its inner surface, a portion of the fluid passes through the plurality of jets and is directed toward the inner surface of the center shaft.

In accordance with another embodiment of the invention, a method of assembling an x-ray tube includes providing a center mount structure having an inner surface and an outer surface, forming a passageway in the center mount structure, the passageway configured to pass a coolant therein, providing a rotatable mount structure having an inner surface, and attaching a target to the rotatable mount structure. The method further includes applying a liquid metal to one of the outer surface of the center mount structure and the inner surface of the rotatable mount structure, coupling the rotatable mount structure to the center mount structure such that the liquid metal is positioned between the outer surface of the center mount structure and the inner surface of the rotatable mount structure, and coupling a porous material to the inner surface of the center mount structure.

Yet another embodiment of the invention includes a spiral groove bearing (SGB) that includes a column having an outer diameter and an inner diameter, the inner diameter partially enclosing a hollow, a mount having a flange thereon, the mount having an inner diameter that is larger than the outer diameter of the column, wherein the flange is configured to attach an x-ray target thereto, and a liquid metal positioned between the outer diameter of the column and the inner diameter of the mount. The SGB also includes a porous-meshed heat transfer-enhancement media coupled to the inner diameter of the column.

The invention has been described in terms of the preferred embodiment, and it is recognized that equivalents, alternatives, and modifications, aside from those expressly stated, are possible and within the scope of the appending claims.

What is claimed is:

1. An x-ray tube comprising:

a center shaft having an inner surface and an outer surface, the inner surface forming a portion of a cavity therein;

a mount having an inner surface, the mount having an x-ray target attached thereto;

a liquid metal positioned between the outer surface of the center shaft and the inner surface of the mount;

a flow diverter positioned in the cavity, the flow diverter having a wall with an inner surface, and a plurality of jets passing through the wall;

wherein the plurality of jets are configured such that when a fluid is flowed into the flow diverter and passes along its inner surface, a portion of the fluid passes through the plurality of jets and is directed toward the inner surface of the center shaft.

2. The x-ray tube of claim 1 comprising a heat transfer-enhancement media coupled to the inner surface of the center shaft, the heat transfer-enhancement media comprising one of graphite, copper, and aluminum.

3. The x-ray tube of claim 1 comprising a heat transfer-enhancement media embedded within the inner surface of the center shaft, the heat transfer-enhancement media comprising one of graphite, copper, and aluminum.

4. The x-ray tube of claim 1 wherein the center shaft is stationary with respect to a frame of the x-ray tube.

5. The x-ray tube of claim 1 wherein the wall of the flow diverter includes an end cap, and the plurality of jets include at least one axial jet positioned in the end cap.

6. The x-ray tube of claim 1 wherein the wall of the flow diverter includes an axial wall passing along an axial length of the x-ray tube, the axial length defining an axis coincident with a rotation axis of the mount, and wherein the plurality of jets are selectively placed along the axial length at hot spots of the inner surface of the center shaft.

7. The x-ray tube of claim 1 wherein the center shaft extends over an entire axial length of the x-ray tube, and the cavity comprises a flow inlet at a first end of the center shaft and a flow outlet at a second end of the center shaft.

8. The x-ray tube of claim 1 wherein the liquid metal comprises one of gallium and an alloy of gallium.

9. A method of assembling an x-ray tube comprising:

providing a center mount structure having an inner surface and an outer surface;

forming a passageway in the center mount structure, the passageway configured to pass a coolant therein;

providing a rotatable mount structure having an inner surface;

attaching a target to the rotatable mount structure;

applying a liquid metal to one of the outer surface of the center mount structure and the inner surface of the rotatable mount structure;

coupling the rotatable mount structure to the center mount structure such that the liquid metal is positioned between the outer surface of the center mount structure and the inner surface of the rotatable mount structure; and coupling a porous material to the inner surface of the center mount structure.

10. The method of claim 9 comprising providing a flow separator in the cavity, the flow separator having a fluid inlet cavity and one or more fluid outlet nozzles, the one or more fluid outlet nozzles positioned to direct a coolant toward the inner surface of the center mount structure.

11. The method of claim 10 wherein the one or more fluid outlet nozzles are positioned in a wall of the flow separator, and positioned to pass a fluid between an inner surface of the wall and an outer surface of the wall.

12. The method of claim 10 wherein the one or more fluid outlet nozzles are configured to pass one of a liquid and a gas.

13. The method of claim 9 wherein providing a center mount structure comprises providing a center mount structure that extends from a first end of the x-ray tube to a second end of the x-ray tube, and wherein the passageway extends from the first end of the x-ray tube to the second end of the x-ray tube.

14. The method of claim 9 wherein providing a center mount structure comprises providing a center mount structure having an end cap, the end cap configured to prevent flow in an axial direction within the passageway.

15. The method of claim 9 wherein applying a liquid metal comprises applying gallium or an alloy thereof.

16. A spiral groove bearing (SGB) comprising:

a column having an outer diameter and an inner diameter, the inner diameter partially enclosing a hollow;

a mount having an inner diameter that is larger than the outer diameter of the column, wherein the mount is configured to attach an x-ray target thereto;

a liquid metal positioned between the outer diameter of the column and the inner diameter of the mount; and a porous-meshed heat transfer-enhancement media coupled to the inner diameter of the column.

17. The SGB of claim 16 comprising:

a flow diverter positioned within the hollow of the column, the flow diverter having a plurality of passageways therein;

wherein the flow diverter is configured such that at least a portion of a fluid passed along an inner surface thereof will pass through the plurality of passageways and be directed toward the inner diameter of the column.

18. The SGB of claim 17 wherein the fluid is one of a liquid and a gas.

19. The SGB of claim 16 wherein the column is configured to extend from a first end of an x-ray tube to a second end of the x-ray tube, and wherein the hollow extends along an entire length of the column.

20. The SGB of claim 16 wherein the column includes an axial endcap configured to block axial flow of fluid within the hollow.

21. The SGB of claim 20 wherein the axial endcap includes at least one of the plurality of passageways therein.

22. The SGB of claim 16 wherein the liquid metal comprises one of gallium and an alloy thereof.

23. The SGB of claim 16 wherein one of the column and the mount is configured to be stationary with respect to a frame of an x-ray tube, and the other of the column and the mount is configured to be rotatable with respect to the frame of the x-ray tube.

* * * * *